United States Patent [19]

Firey

[11] Patent Number: 4,707,991

[45] Date of Patent: Nov. 24, 1987

[54] MULTIPLE REACTOR CYCLIC VELOX BOILER PLANT

[76] Inventor: Joseph C. Firey, P.O. Box 15514, Seattle, Wash. 98115-0514

[21] Appl. No.: 35,895

[22] Filed: Apr. 8, 1987

[51] Int. Cl.[4] ..... F01K 13/00

[52] U.S. Cl. ..... 60/670; 60/39.01; 122/1 C; 122/449; 122/452

[58] Field of Search ..... 60/670, 39.01; 122/1 C, 122/449, 452; 110/342

[56] References Cited

U.S. PATENT DOCUMENTS

| | | | |
|---|---|---|---|
| 1,913,395 | 6/1933 | Karrick | 48/203 |
| 2,225,311 | 12/1940 | Lysholm | 60/39.04 |
| 2,624,172 | 1/1953 | Houdry | 60/39.04 |
| 2,675,672 | 4/1954 | Schorner | 60/39.12 |
| 2,714,670 | 8/1955 | Linder et al. | 60/39.5 |
| 3,734,184 | 5/1973 | Scott | 48/210 |
| 4,047,901 | 9/1977 | Baron et al. | 48/77 |
| 4,085,578 | 4/1978 | Kydd | 60/39.02 |

*Primary Examiner*—Edward G. Favors

[57] ABSTRACT

A dual or multiple combustion chamber is described for use with cyclic velox boiler plants wherein one or more inner reactors are fastened inside one or more of the combustion containers of the cyclic velox boiler. These inner reactors are filled with and contain the char fuel but the inner reactor walls are porous and ported so that air can readily flow into the inner reactor during compression and reacted gases can readily flow out of the inner reactor during expansion. Refueling and ash removal occur into and out of these inner reactor chambers.

8 Claims, 3 Drawing Figures

SECTION B-B OF FIGURE 2

MULTIPLE REACTOR CYCLIC VELOX BOILER PLANT

CROSS REFERENCES TO RELATED APPLICATION

The invention described herein is related to my following U.S. patent applications:

1. "Solid With Gas Reactor Plant," Ser. No. 791,798, filed Oct. 28, 1985.
2. "Untimed Refuel And Ash Removal For Char Burning Engines," Ser. No. 819,362, filed Jan. 16, 1986, now standing allowed with the issue fee paid.
3. "Reactant Reservoirs For Cyclic Reactors," Ser. No. 856,808, filed Apr. 28, 1986.

INFORMATION DISCLOSURE STATEMENT

The invention described herein is an improvement upon my earlier described inventions entitled:

a. "Cyclic Velox Boiler," U.S. Pat. No. 4,455,837, issued June 26, 1984, from which material is incorporated herein by reference.
b. "Cyclic Velox Boiler," U.S. Pat. No. 4,484,531, issued Nov. 27, 1984, a process divisional from above U.S. Pat. No. 4,455,837.

These cyclic velox boilers are in turn an improvement upon my earlier described inventions entitled:

c. "Cyclic Char Gasifier," U.S. Pat. No. 4,509,957, issued Apr. 9 1985.
d. "Cyclic Char Gasifier Oxidation Process," U.S. Pat. No. 4,568,361, issued Feb. 4, 1986.
e. "Cyclic Char Gasifier With Product Gas Divider," U.S. Pat. No. 4,533,362, issued Aug. 6, 1985.

The relation between my cyclic velox boilers and these cyclic char gasifiers is described in my U.S. Pat. No. 4,455,837, column 4, line 45, through column 24, line 40, including the drawings, and this material is incorporated herein by reference thereto. Essentially, a cyclic velox boiler is an oxidation cyclic char gasifier whose pressure vessel container walls are steam boilers.

BACKGROUND OF THE INVENTION

The background of this invention is the same as the background of my invention, "Cyclic Velox Boiler," as described in U.S. Pat. No. 4,455,837, column 1, line 22, through column 4, line 43, and this material is incorporated herein by reference thereto.

SUMMARY OF THE INVENTION

The invention described herein is an improvement upon my cyclic velox boiler plant described in U.S. Pat. Nos. 4,455,837 and 4,484,531. The containers of a cyclic velox boiler, wherein the primary and secondary combustion reactions occur, are each divided into two or more separate chambers, one or more inner reactor chambers being fastened inside one or more containers. The inner reactor chambers are filled with and contain the char fuel supplied thereto by the refuel means. Ashes are removed from the inner reactor chamber. The inner reactor chamber walls are porous or ported so that air can readily flow from the surrounding container into the inner reactor chamber during compression so that the primary reaction can take place within the inner reactor. During subsequent expansion the gases of primary reaction can readily flow out of the inner reactor chamber and mix with secondary air in the surrounding container where the secondary reaction takes place.

Refueling can be simplified since the refuel means need only completely refill the inner reactor chamber. In some forms of this invention, the inner reactor chamber walls are hollow and water is passed therethrough as part of the boiler heat transfer surface. In this way boiler heat transfer area can be increased.

DESCRIPTION OF THE PREFERRED EMBODIMENTS

Figure 1:
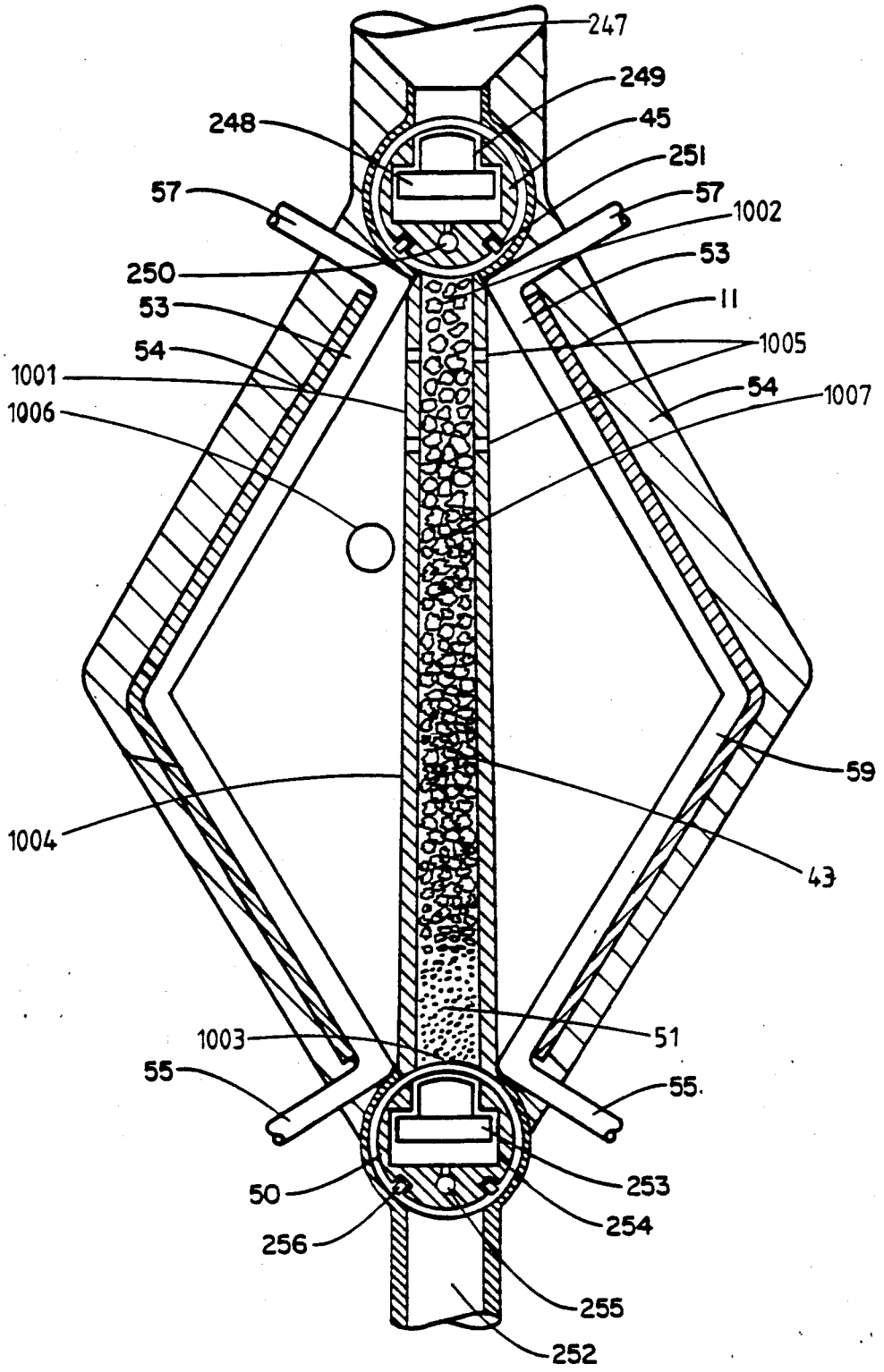
In FIG. 1 is shown a cross section of one of the containers of a cyclic velox boiler plant equipped with a single multiple reactor.

All forms of this multiple reactor cyclic velox boiler invention are improvements upon cyclic velox boiler plants and comprise the following elements:

1. A cyclic velox boiler plant, as described in U.S. Pat. No. 4,455,837 in column 4, line 45 through column 58, line 56, and this material and FIGS. 1 through 18 therefrom are incorporated herein by reference thereto. A cyclic velox boiler plant comprises a cyclic char gasifier plant of the oxidation type and using several pressure vessel containers, to which is added a steam boiler, a portion of which is the walls of the pressure vessel containers. The combustion gases of the cyclic char gasifier are cooled by this steam boiler before passing into the expander engine and the steam thus generated can pass through a steam turbine engine to generate additional power. Preferably, the cyclic char gasifier is modified to carry out essentially full burning of the fuel to carbon dioxide and water at pressure within the containers of the cyclic char gasifier plant. A description of cyclic oxidation char gasifiers of the pressure vessel type suitable for use in cyclic velox boiler plants is presented in my U.S. patent application, Ser. No. 328,148, filed Dec. 7, 1981 (now abandoned). Descriptions of cyclic oxidation char gasifiers of the pressure vessel type and suitable for use in cyclic velox boiler plants are also presented in my following issued U.S. Pat. Nos.:

4,509,957; 4/9/85; "Cyclic Char Gasifier"
4,533,362; 8/6/85; "Cyclic Char Gasifier With Product Gas Divider"
4,568,361; 2/4/86; "Cyclic Char Gasifier Oxidation Process"

Various forms of cyclic velox boiler plant are described in the material incorporated by reference from U.S. Pat. No. 4,455,837, and the term "cyclic velox boiler plant" is used herein and in the claims of this invention to mean any one of these various forms.

2. The improvement of this invention comprises adding to a cyclic velox boiler plant a number of inner reactor chambers and a means for fastening these inner reactor chambers inside the pressure vessel containers of the cyclic velox boiler. The number of inner reactor chambers is an integral multiple, preferably one, of the number of containers, and the number of inner reactors fastened inside each container equals this integral multiple. The walls of each inner reactor chamber are porous or are fitted with ports or both so that gases can flow readily into the inner reactor chamber during compression and so that gases can flow readily out of the inner reactor chamber during expansion. The walls of each inner reactor chamber are capable of containing any char fuel placed inside the inner reactor chamber. Each inner reactor chamber has an inlet and the inner reactor chambers are so fastened into each container that refueling of a container places fresh char fuel only into the inner reactor chambers via these inlets. Each inner reactor chamber also has an outlet and the inner reactor chambers are so fastened into each container that coke removal (or ash removal) removes non-gas material only from the inner reactor chambers via these outlets.

In a multiple reactor cyclic velox boiler, thusly created by this improvement, the primary reaction of air with char fuel during compression takes place inside the inner reactor chamber since all char fuel is located therein. Similarly, the secondary reaction of primary product gases with secondary air takes place during expansion outside the inner reaction chamber but inside the containers since the secondary air is located there. Refueling and refuel control can be simplified since the inner reactor chambers need only be kept essentially full of char fuel and a char fuel height sensor and control means is not necessary. This is one of the beneficial objects of this invention. Also, an untimed refuel and ash removal means, as described in my cross-referenced U.S. patent application, Ser. No. 819,362, can readily be used with a multiple reactor cyclic velox boiler of this invention since the inner reactor chambers need only be kept essentially full of char fuel. Use of an untimed refuel and ash removal means simplifies these refuel and ash removal means and this is another beneficial object of this invention.

The foregoing elements are present in all forms of this invention. Certain of these minimum elements can be modified and added elements can be introduced to create other types of multiple reactor cyclic velox boilers.

Additional steam boiler heat transfer area can be created by adding a boiler means to the walls of the inner reactor chamber and this is an added element. This inner reactor boiler is a means for heating and boiling liquid water at pressure and comprises a water inlet and a water outlet. The inner reactor walls are thusly cooled by the water inside the boiler means and a wider variety of materials can be satisfactorily used for the walls of the inner reactor and this is a beneficial object of this added boiler means element. Preferably, liquid water is delivered into the water inlet of this inner reactor boiler means in order to assure adequate cooling of the walls. This inner reactor boiler means can be connected into the cyclic velox boiler means in many different ways, as for example:

1. Where each container of the cyclic velox boiler means comprises a radiant heater means, the inner reactor boiler means of each container can be connected in parallel to the radiant heater means of that same container by connecting the liquid water inlet of the radiant heater means to the water inlet of the inner reactor boiler means and connecting the water outlet of the radiant heater means to the water outlet of the inner reactor boiler means.

2. Where each container of the cyclic velox boiler means comprises a radiant heater means, the inner reactor boiler means of each container can be connected in series after the radiant heater means of that same container by connecting the water outlet of the radiant heater means to the water inlet of the inner reactor boiler means and connecting the water outlet of the inner reactor boiler means to other portions of the cyclic velox boiler means or to the boiler steam outlet thereof.

3. Where each container of the cyclic velox boiler means comprises a radiant heater means, the inner reactor boiler means of each container can be connected in series before the radiant heater means of that same container by connecting the water outlet of the inner reactor boiler means to the liquid water inlet of the radiant heater means and connecting the water inlet of the inner reactor boiler means to other portions of the cyclic velox boiler means or to the boiler feedwater inlet thereof.

4. The inner reactor boiler means can also be used as a steam superheater or as a steam reheater or as a feedwater heater or for other boiler purposes.

In many applications we desire effective cooling of both the container walls and the inner reactor chamber walls and for these purposes it is preferable to connect the inner reactor boiler means in series or parallel to the radiant heater means as described in (1), (2), or (3) above. However, effective cooling of the inner reactor chamber walls also chills that char fuel portion adjacent to these walls and, as a result, these char fuel portions may not burn completely. To assure complete burnup of these char fuel portions adjacent to the walls of the inner reactor chamber, a ceramic liner can be placed inside the inner reactor chamber to separate the char fuel from contact with that portion of the walls of the inner reactor chamber towards the outlet thereof.

A particular example of an inner reactor chamber fastened inside one of the containers of a cyclic velox boiler plant is shown in FIG. 1. A single inner reactor chamber, 1001, is fastened inside the container, 11, with the inlet, 1002, of the inner reactor chamber fitted to the refuel transfer means, 45, so that whenever the refuel transfer means, 45, transfers char fuel into the container, 11, the transferred fuel goes only into the inlet, 1002, of the inner reactor chamber, 1001. Similarly the outlet, 1003, of the inner reactor chamber, 1001, is fitted to the coke removal transfer means, 50, so that whenever the coke removal transfer means, 50, transfers non-gas materials out of the container, 11, the transferred material comes only from the outlet, 1003, of the inner reactor chamber. The walls, 1004, of the inner reactor chamber, 1001, are porous and are also fitted with ports, 1005, so that gases can readily flow inside the inner reactor chamber, 1001, from the dead volume, 44, of the container, 11, whenever the container, 11, is undergoing compression via the connection, 1006, and so that gases can readily flow out of the inner reactor chamber, 1001, into the dead volume, 44, of the container, 11, whenever the container, 11, is undergoing expansion via the connection, 1006. The pores and ports, 1005, in the wall, 1004, of the inner reactor chamber, 1001, are made smaller than the size of the chunks of char fuel, 1007, inside the inner reactor chamber, 1001, so that the char fuel and ashes are contained inside the inner reactor chamber. For the multiple reactor cyclic velox boiler plant of which FIG. 1 shows one of the containers, 11, only one inner reactor chamber is placed inside the container, 11, so the integral multiple is one for this example. In most cases, each container of a cyclic velox boiler plant would be similarly fitted with an equal number of inner reactor chambers but this is not necessary. All of the containers of the cyclic velox boiler plant, of which container, 11, of FIG. 1 is an example, can operate within the cyclic velox boiler plant in the same manner as described in my U.S. Pat. No. 4,455,837, as incorporated herein by reference thereto, except that the char fuel is retained inside the inner reactor chamber, 1001.

Please note that FIG. 1, as described above, is a modified form of the FIG. 3 of my U.S. Pat. No. 4,455,837, to show the inner reactor chamber and the several component identifying numbers are the same for both drawings except for those numbers between 1000 and 2000.

It is not necessary that the inner reactor chamber, 1001, be filled with char fuel and ashes, and in this case refueling and coke or ash removal and the sensing and control thereof can take place in the same way as described in the material incorporated by reference from my U.S. Pat. No. 4,455,837.

Alternatively, and in many applications preferably, the inner reactor chamber, 1001, is kept essentially full of char fuel and ashes and the refuel means functions to keep the inner reactor chamber thusly filled. For example, a fixed refueling time interval can be used with the refueling volume of the refuel transfer means, 45, larger than the maximum char fuel volume consumed during the refueling time interval. In this case the refuel transfer means, 45, merely adds whatever portion of its refueling volume is needed to completely refill the inner reactor chamber, 1001. With this case of fixed refuel time interval no sensor or control means is needed for the refuel means and this simplification is one of the beneficial objects of this invention.

Also with this case the fixed refueling time interval can be set equal to an integral multiple, Z, of the cycle time, tc. Also in this case refueling can be timed, if desired, to occur only when a container has completed a sequence of compression followed by expansion and is thus at a low internal pressure and gas leakage during refueling can be minimized.

An untimed refuel and reload means, such as is described in my copending, cross-referenced application entitled, "Untimed Refuel And Ash Removal For Char Burning Engines," Ser. No. 819,362, can be used with those multiple reactor cyclic velox boilers of this invention which keep the inner reactor chamber essentially full of char fuel. With such an untimed refuel means, the refuel piston, 248, acts continuously to push char fuel into the inlet, 1002, of the inner reactor chamber, 1001, until the refuel piston, 248, reaches the end of its travel and the refuel transfer means, 45, has been emptied of char fuel. After being thusly emptied, the refuel transfer means, 45, is rotated 180 degrees into the position shown in FIG. 1, where reloading of fresh char fuel occurs from the char fuel supply hopper, 247. The refuel transfer means, 45, is thereafter rotated 180 degrees back into alignment with the inlet, 1002, of the inner reactor chamber, 1001, and pressure reapplied via the pressure supply hole, 250, so that the refuel piston, 248, is again acting continuously to push char fuel into the inner reactor chamber. With this untimed refuel means the refuel piston, 248, acts in effect as a char fuel volume sensor and this is a simpler sensor and control means than the refuel sensor and control means described in the material incorporated by reference from my U.S. Pat. No. 4,455,837. This is one of the beneficial objects made available by use of the multiple inner reactor chambers of this invention.

An untimed coke removal or ash removal means, such as is described in my copending cross-referenced application entitled, "Untimed Refuel And Ash Removal For Char Burning Engines," Ser. No. 819,362, can be used with the multiple reactor cyclic velox boilers of this invention. An untimed ash removal means functions in essentially the same manner as the above described untimed refuel means except that the ash removal means removes a volume of non-gas material from the inner reactor chambers via their outlets whereas the refuel means adds a volume of char fuel into the inner reactor chambers via their inlets. Because of this difference in function, an ash level sensor and control means is needed when an untimed ash removal means is used for removal of essentially fully burned ashes. Examples of such ash level sensors and control means are described in the material incorporated by reference from my U.S. Pat. No. 4,455,837. Ashes can alternatively be removed continuously via the outlet of the inner reactor chamber if in the molten state via an ash orifice as is described in the material incorporated by reference from my U.S. Pat. No. 4,455,837.

Occasionally it is desired to remove partially oxidized coke from the containers, and hence the inner reactors, as a product material. In these cases the coke removal means is to remove a volume of non-gas material proportional to the volume of char fuel added by the refuel means. This proportion or the ratio of coke removal volume to char refuel volume can be set in various ways when untimed refuel and coke removal means are used as, for example, the following:

1. Coke removal takes place once with each refueling and the proportion is set by the ratio of the volume capacity of the coke removal mechanism to that of the refuel mechanism. Where it is desired to be able to change the proportion, either the coke removal mechanism volume or the refuel mechanism volume can be made adjustable.

2. Coke removal takes place less than once with each refueling and the proportion is set by the ratio of the number of coke removals per unit of time to the number of refuelings per unit of time.

When coke is removed in set proportion to refuel addition an ash level sensor and control means is not needed.

Figure 2:
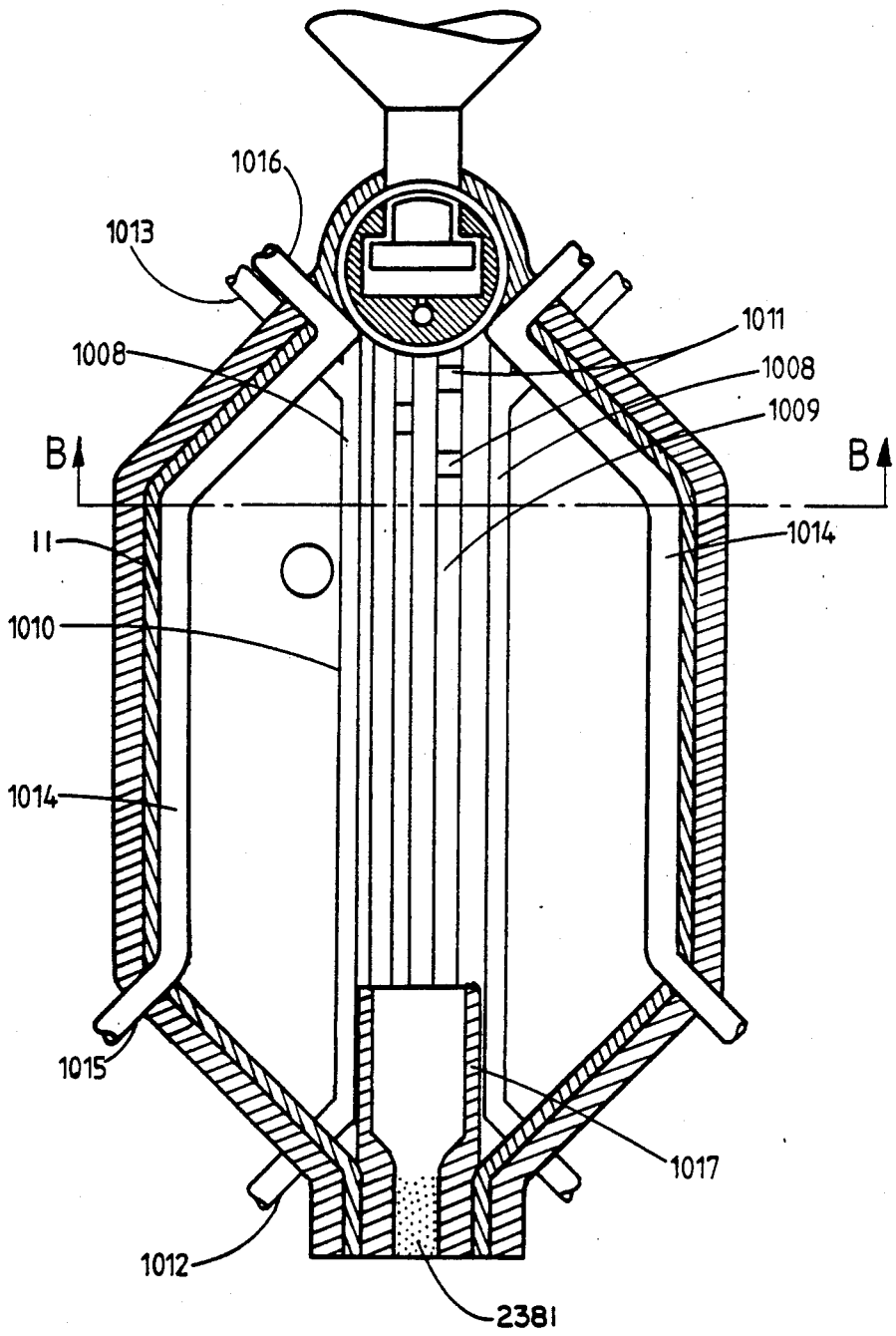
In FIG. 2 is shown another cross section of another container of a cyclic velox boiler plant comprising a multiple reactor fitted with an inner reactor boiler means.
Figure 3:
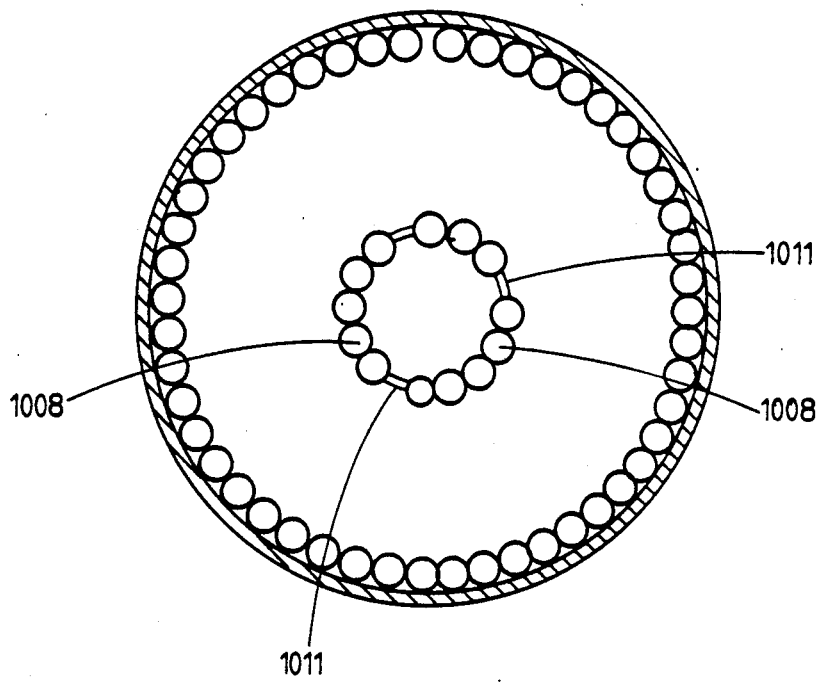
In FIG. 3 is shown the cross section B—B of FIG. 2.

To the walls of the inner reactor chamber can be added a boiler means, an example of which is shown in FIG. 2 and also in FIG. 3 which is the cross section B—B of FIG. 2. The example inner reactor chamber boiler means of FIG. 2 and FIG. 3 comprises the following:

1. Several boiler tubes, 1008, are fastened together to form the wall, 1009, of the inner reactor chamber, 1010. Gaps, 1011, in the fastenings between boiler tubes provide the ports needed for free flow of gases into and out of the inner reactor chamber, 1010.

2. A water inlet, 1012, to the inner reactor boiler means is provided.

3. A water outlet, 1013, from the inner reactor boiler means is provided.

4. Although each boiler tube, 1008, can in principle have its own separate water inlet and water outlet, it is usually preferable to connect all boiler tubes to a common water inlet and to a common water outlet. However, for a once-through type of boiler, it may be preferred to connect the several boiler tubes, 1008, in series.

Please note that FIG. 2, as described above, is a modified form of the FIG. 15 of my U.S. Pat. No. 4,455,837, to show the inner reactor chamber and the inner reactor boiler means, and the several component identifying numbers are the same for both drawings except for those numbers between 1000 and 2000.

The inner reactor boiler means can be connected into the cyclic velox boiler means in various ways of which the following are particular examples:

1. The inner reactor boiler means can be connected in parallel to the radiant heater means, 1014, inside the container, 11, by connecting the inlet, 1012, of the inner reactor boiler to the inlet, 1015, of the radiant heater means, 1014, and also connecting the outlet, 1013, of the inner reactor boiler to the outlet, 1016, of the radiant heater means, 1014. This parallel connection might be preferred in sub-critical pressure cyclic velox boilers using natural or forced boiler water recirculation since such recirculation can assure water flow into all of the parallel boiler means.

2. The inner reactor boiler means can be connected in series before the radiant heater means, 1014, inside the container, 11, by connecting the outlet, 1013, of the inner reactor boiler to the inlet, 1015, of the radiant heater means, 1014, and also connecting the inlet, 1012, of the inner reactor boiler to other portions of the cyclic velox boiler such as the boiler feedwater inlet.

3. The inner reactor boiler means can be connected in series after the radiant heater means, 1014, inside the container, 11, by connecting the inlet, 1012, of the inner reactor boiler to the outlet, 1016, of the radiant heater means, 1014, and also connecting the outlet, 1013, of the inner reactor boiler to other portions of the cyclic velox boiler means such as the boiler steam outlet.

These series connections might be preferred in once through boilers, such as used at critical or super-critical boiler pressures, to assure water flow through all boiler channels.

A liner, 1017, of ceramic or other suitable insulating material, can be placed inside the lower portion toward the outlet end of the inner reactor chamber so that those char fuel portions, chilled by contact with the boiler tubes, 1008, of the inner reactor boiler means, will have an opportunity to be heated up and fully burned up before leaving the inner reactor chamber.

Use of an inner reactor boiler means has the advantage of increasing the total boiler heat transfer area of the cyclic velox boiler. However, it will usually have the disadvantage of decreasing that portion of the boiler heat transfer area where radiant heat transfer predominates since the inner reactor boiler means shields the larger radiant heater means from char fuel pile radiation.

The internal volume, (VIR), of the inner reactor chamber can be estimated as that volume needed to contain the char fuel gross volume, (CGV), plus the volume of ashes, plus the interstitial volume between chunks of char fuel. The plant sizing relations presented in the material incorporated by reference from my U.S. Pat. No. 4,455,837, can be used to estimate (VIR) with the additional quantity, the percent interstitial volume, (% Int.), defined as follows:

(% Int)=Percent of (VIR) unoccupied by ashes or the gross char fuel chunks

The value of (% Int) varies with the size and shape of the char fuel chunks and is best determined experimentally for the particular char fuel to be used. Rough estimates of the values of (% Int) can be made, if average char fuel chunk volume can be estimated, by assuming spherical char fuel chunk geometry. In these terms the value of (VIR) can be estimated by use of the following relation:

$$(VIR) = \frac{(100)(VT)}{[100-(\%\ Int)]}\left[\frac{(1-fD)(1-fA)}{(fD)\left(\frac{\%\ Pore}{100}\right)+(1-fD)}+(fA)\right]$$

Wherein the various quantities are as defined in the material incorporated by reference from my U.S. Pat. No. 4,455,837.

Any consistent system of units can be used for these sizing equations.

Having thus described my invention, what I claim is:

1. The combination of a cyclic velox boiler plant comprising: a cyclic oxidation char gasifier plant comprising:

at least one compressor means for compressing gases from a lower pressure to a higher pressure and each such compressor means comprising at least one stage and each such stage comprising an inlet and an outlet end;

at least one expander means for expanding gas from a higher pressure to a lower pressure and each such expander means comprising at least one stage and each such stage comprising an inlet end and a discharge end;

at least two separate containers, each of said containers comprising pressure vessel means for containing char fuel and any gas compressed into said char fuel, each such container comprising interior surfaces on the combustion side;

power means for driving said compressors and for absorbing any mechanical work done upon said expanders by said expanding gas;

each such expander means comprising an expander discharge;

at least one char fuel heater, said char fuel heater comprising means for heating a portion of the char fuel within each of said containing means to that temperature at which said char will react rapidly with oxygen in adjacent compressed reactant gases when said cyclic char gasifier plant is being started;

at least one reactant gas supply source of gas containing appreciable oxygen gas;

each such compressor whose number of stages exceeds one further comprising fixed open gas flow connections from the outlet end of each compressor stage, except one, to the inlet end of one other stage of said compressor, whereby said stages of said compressor are connected in series so that the pressure of a particular gas mass, at delivery from each stage, increases as said gas mass is compressed through said series connected stages, from the inlet end to the outlet end of each stage, with the first stage in said series through which a gas mass first flows being both the lowest pressure stage and also that one stage whose inlet end does not have a fixed open gas flow connection from the outlet end of any other stage of said compressor, and with the last-stage in said series through which a gas mass last flows being both the highest pressure stage and also that one stage whose outlet end does not have a fixed open gas flow connection to the supply end of any other stage of said compressor;

fixed open gas flow connections from the inlet end of the lowest pressure stage of each of said compressors to at least one reactant gas supply source of gas containing appreciable oxygen gas;

each such expander whose number of stages exceeds one further comprising fixed open gas flow connections from the discharge end of each expander stage, except one, to the inlet end of one other stage of said expander, whereby said stages of said expander are connected in series so that the pressure of a particular gas mass, at discharge from each stage, decreases as said gas mass is expanded through said series connected stages, from the inlet end to the discharge end of each stage, with the first stage in said series through which a gas mass first flows being both the highest pressure stage and also that one stage whose inlet end does not have a fixed open gas flow connection from the discharge end of any other stage of said expander, and with the last stage in said series through which a gas mass last flows being both the lowest pressure stage and also that one stage whose discharge end does not have a fixed open gas flow connection to the inlet end of any other stage of said expander;

fixed open gas flow connections from the discharge end of the lowest pressure stage of each of said expanders to said expander discharge;

changeable gas flow connections, which are openable and closeable, from each of said containers to each outlet end of each stage of each of said compressors and to each inlet end of each stage of each of said expanders;

each cyclic char gasifier plant comprising a number of said containers, with changeable gas flow connections to said compressors and to said expanders, at least equal to the sum of the number of compressor stages of all compressors, and the number of expander stages of all expanders;

at least one refuel mechanism, said refuel mechanism comprising;

means for transferring a volume of solid materials from a supply source into said containing means when said refuel transfer means is connected to said containing means; means for connecting said refuel transfer means for connecting said refuel transfer means to said containing means for a time period for refueling and for disconnecting said refuel transfer means from said containing means at the end of said refuel time period;

means for sealing said refuel means for connecting and disconnecting against gas leakage;

at least one coke removal mechanism, said coke removal mechanism comprising;

means for transferring a volume of non-gas materials out of said containing means;

means for opening and closing said changeable gas flow connections so that each container is opened for a time period to each outlet end of each stage of each of said compressors, in a sub-sequence of time periods of open gas flow connections to compressors, said subsequence proceeding in time order of increasing compressor stage delivery pressure, and is opened for a time period to each inlet end of each stage of each of said expanders, in a sub-sequence of time periods of open gas flow connections to expanders, said sub-sequence proceeding in time order of decreasing expander stage inlet pressure, said sub-sequence of connections to said compressors being followed by said sub-sequence of connections to said expanders, and these together comprise one sequence of time periods of open gas flow connections, each of said containers is opened to only one stage during any one time period of said sequence of time periods, said sequence of time periods of open gas flow connections to said compressors and to said expanders is repeated for each of said containers by said means for opening and closing means for controlling said means for opening and closing, and said means for connecting said refuel transfer means and said coke removal transfer means, so that said repeated sequences of time periods of open gas flow connections, and any time periods available only for refueling and for coke removal, are a continuous series of time periods for any one containing means, and so that the delivery end of each stage of each compressor has an open gas flow connection to one containing means, and the inlet end of each stage of each expander has an open gas flow connection to one containing means, during all time periods, whenever said plant is operating;

said cyclic velox boiler machine further comprising:

boiler means for heating and boiling liquid water at pressure and for heating steam at pressure, and comprising a boiler feedwater inlet and a boiler steam outlet, at least one portion of said boiler means comprising at least one radiant heater means positioned on the interior surfaces of one of said containers, each such radiant heater comprising a liquid water inlet and a water outlet;

a source of boiler feedwater;

feedwater pumping means for pumping liquid water into said boiler means from said feedwater supply source and comprising a drive means for driving said feedwater pump and a control means for controlling the flow rate of water pumped;

feedwater pump connecting means for connecting said feedwater pumping means to said boiler means and to said feedwater supply source so that liquid water is forced into said boiler liquid water inlet whenever said plant is operating;

sensor and control means for sensing the quantity of char fuel within each said container when said plant is operating and operative upon said means for connecting said refuel transfer means so that, when the volume of char fuel within any one container becomes less than a minimum set value, said refuel transfer means is connected to that container by said means for connecting said refuel means, and when the volume of char fuel within any one said container exceeds a maximum set value, said refuel transfer means is disconnected from that container by said means for connecting said refuel means;

wherein the improvement comprises adding thereto:

a number of inner reactor chambers equal to an integral multiple of the number of said containers, each said inner reactor chamber comprising, walls through which gases can readily flow and which can contain solid fuels placed inside said inner reactor chamber, an inlet, and an outlet;

means for fastening a number of said inner reactor chambers equal to said integral multiple inside each said container so that, said refuel transfer means connects only to said inner reactor inlets whenever said refuel transfer means is connected to any one of said containers, said coke removal mechanism removes non-gas materials only from said inner reactor outlets;

whereby said cyclic velox boiler plant becomes a multiple reactor cyclic velox boiler plant.

2. The combination of a multiple reactor cyclic velox boiler plant as described in claim 1:

wherein the number of said radiant heater means equals the number of said containers, and each said container has one said radiant heater means positioned on its interior surfaces;

wherein said walls of each said inner reactor comprise inner boiler means for heating and boiling liquid water at pressure and for heating steam at pressure, said inner boiler means comprising a water inlet and a water outlet;

and further comprising means for connecting each said inner boiler means to each said radiant heater means of that said container means within which said inner boiler means are fastened, so that, said inner boiler means water inlet is connected to said radiant heater means liquid water inlet and said inner boiler means water outlet is connected to said radiant heater means water outlet.

3. The combination of a multiple reactor cyclic velox boiler plant as described in claim 1:

wherein the number of said radiant heater means equals the number of said containers, and each said container has one said radiant heater means positioned on its interior surfaces;

wherein said walls of each said inner reactor comprise inner boiler means for heating and boiling liquid water at pressure and for heating steam at pressure, said inner boiler means comprising a water inlet and a water outlet;

and further comprising means for connecting each said inner boiler means to each said radiant heater means of that said container means within which said inner boiler means are fastened, so that, said inner boiler means water inlet is connected to said radiant heater means water outlet and said inner boiler means water outlet is connected to said boiler means boiler steam outlet.

4. The combination of a multiple reactor cyclic velox boiler plant as described in claim 1:

wherein the number of said radiant heater means equals the number of said containers, and each said container has one said radiant heater means positioned on its interior surface;

wherein said walls of each said inner reactor comprise inner boiler means for heating and boiling liquid water at pressure and for heating steam at pressure, said inner boiler means comprising a water inlet and a water outlet;

and further comprising means for connecting each said inner boiler means to each said radiant heater means of that said container means within which said inner boiler means are fastened, so that, said inner boiler means water inlet is connected to said boiler means boiler feedwater inlet and said inner boiler means water outlet is connected to said radiant heater means liquid water inlet.

5. The combination of a multiple reactor cyclic velox boiler plant as described in claim 1:

wherein said coke removal transfer means transfers a volume of non-gas materials out of said containing means only when connected to said container, and further comprising:

means for connecting said coke removal transfer means to said containing means for a time period for coke removal and for disconnecting said coke removal transfer means from said containing means at the end of said coke removal time period;

means for sealing said coke removal transfer means for connecting and disconnecting against gas leakage;

sensor and control means for sensing the quantity of ashes within each said container when said plant is operating and operative upon said means for connecting said coke removal transfer means so that, when the volume of ashes within any one said container exceeds a maximum set value, said coke removal transfer means is connected to that container by said means for connecting said coke removal transfer means, and when the volume of ashes within any one said container becomes less than a minimum set value, said coke removal transfer means is disconnected from that container by said means for connecting said coke removal transfer means;

and further wherein said coke removal transfer means connects only to said inner reactor outlets whenever said coke removal transfer means is connected to any one of said containers.

6. The combination of a multiple reactor cyclic velox boiler plant as described in claim 5:

wherein the number of said radiant heater means equals the number of said containers, and each said container has one said radiant heater means positioned on its interior surfaces;

wherein said walls of each said inner reactor comprise inner boiler means for heating and boiling liquid water at pressure and for heating steam at pressure, said inner boiler means comprising a water inlet and a water outlet;

and further comprising means for connecting each said inner boiler means to each said radiant heater means of that said container means within which said inner boiler means are fastened, so that, said inner boiler means water inlet is connected to said radiant heater means liquid water inlet and said inner boiler means water outlet is connected to said radiant heater means water outlet.

7.

The combination of a multiple reactor cyclic velox boiler plant as described in claim 5:

wherein the number of said radiant heater means equals the number of said containers, and each said container has one said radiant heater means positioned on its interior surfaces;

wherein said walls of each said inner reactor comprise inner boiler means for heating and boiling liquid water at pressure and for heating steam at pressure, said inner boiler means comprising a water inlet and a water outlet;

and further comprising means for connecting each said inner boiler means to each said radiant heater means of that said container means within which said inner boiler means are fastened, so that, said inner boiler means water inlet is connected to said radiant heater means water outlet and said inner boiler means water outlet is connected to said boiler means boiler steam outlet.

8. The combination of a multiple reactor cyclic velox boiler plant as described in claim 5:

wherein the number of said radiant heater means equals the number of said containers, and each said container has one said radiant heater means positioned on its interior surfaces;

wherein said walls of each said inner reactor comprise inner boiler means for heating and boiling liquid water at pressure and for heating steam at pressure, said inner boiler means comprising a water inlet and a water outlet;

and further comprising means for connecting each said inner boiler means to each said radiant heater means of that said container means within which said inner boiler means are fastened, so that, said inner boiler means water inlet is connected to said boiler means boiler feedwater inlet and said inner boiler means water outlet is connected to said radiant heater means liquid water inlet.

* * * * *